United States Patent [19]

Garnett et al.

[11] 4,007,143

[45] Feb. 8, 1977

[54] METHOD OF GRAFTING MONOMERS TO WOOL WITH NITRIC ACID

[76] Inventors: John Lyndon Garnett, 29 Arabella St., Longueville, New South Wales, Australia, 2066; Robert Sydney Kenyon, 29 Glen St., Eastwood, New South Wales, Australia, 2122

[22] Filed: June 10, 1975

[21] Appl. No.: 585,695

Related U.S. Application Data

[63] Continuation of Ser. No. 462,331, April 19, 1974, abandoned, which is a continuation of Ser. No. 337,098, March 1, 1973, abandoned.

[30] Foreign Application Priority Data

Mar. 7, 1972 Australia ..... 8189/72

[52] U.S. Cl. ..... 260/8; 204/159.12; 204/160.1; 204/159.15; 260/17.4 GC

[51] Int. Cl.[2] ..... C08L 1/00; C08L 3/00; C08L 89/00

[58] Field of Search ..... 204/160.1, 159.12, 159.15; 260/17.4 GC, 8

[56] References Cited

UNITED STATES PATENTS

| | | | |
|---|---|---|---|
| 3,514,385 | 5/1970 | Mogat et al. | 204/159.12 |
| 3,522,158 | 7/1970 | Garnett et al. | 204/159.12 |
| 3,565,780 | 2/1971 | Zimmerman | 204/159.15 |
| 3,589,856 | 6/1971 | Wolfram | 260/8 |
| 3,748,241 | 7/1973 | Garnett et al. | 204/159.12 |

*Primary Examiner*—Richard B. Turer
*Attorney, Agent, or Firm*—Jones, Thomas & Askew

[57] ABSTRACT

Monomers containing sterically available vinyl groups can be copolymerized with wool in the presence of a mineral acid or an organic acid containing up to 3 carbon atoms. The effect can be enhanced by conducting the reaction in the presence of an activating radiation.

9 Claims, No Drawings

METHOD OF GRAFTING MONOMERS TO WOOL WITH NITRIC ACID

This is a continuation of application Ser. No. 462,331, filed Apr. 19, 1974, now abandoned, which was a continuation of application Ser. No. 337,098, filed Mar. 1, 1973, now abandoned.

The present invention relates to a method of grafting monomers to wool, and more particularly to the grafting of monomers containing vinyl groups to wool.

It is known that it is possible to graft vinyl monomers to polymeric "backbone" molecules such as cellulose using radiation to initiate the reaction. It has also been found that the radiation initiated grafting of vinyl monomers to cellulose is facilitated in the presence of acid. The present inventors have now made a further significant advance in the discovery that vinyl monomers can be grafted onto wool in the presence of an acid without the need for radiation initiation although such initiation can be used to speed up the reaction.

The present invention consists in a method of grafting a monomeric substance containing a sterically available vinyl group onto wool comprising contacting the wool with the monomer or a solution of the monomer in a polar solvent in the presence of a mineral acid of an organic acid containing up to 3 carbon atoms.

In a preferred embodiment of the invention the wool, while in contact with the monomer, or the monomer solution, is irradiated with an activating radiation.

It has been found that the natural properties of wool can be varied greatly by the grafting thereof of vinyl monomers. The physical properties of the wool fibres can be varied such that it may be possible to make the wool fibres more wear resistant or to imparting anti-wrinkling properties to fabrics manufactured from the wool. The chemical properties of the wool can also be varied to make the wool suitable for use in the chromatographic separation of substances and for use as an ion exchange medium. The treated wool could also be used as an adsorbent, i.e. a scavenger filter, for metal ions and polar molecules in such things as water effluents and waste gasses.

The monomers which are suitable for use in the present invention are those containing in the molecule a sterically available vinyl group, i.e. a vinyl group so placed in the molecule as to be able to undergo polymerisation reactions. Monosubstituted vinyl compounds graft most readily; styrene being the most reactive of the monomers studied; of the disubstituted vinyl compounds those with both substituents on the one carbon atom are more reactive than the 1,2 disubstituted monomers, i.e. the compounds containing a terminal vinyl group are the more reactive.

The reaction conditions should be selected so as to reduce homopolymerisation as far as possible. Some substituted vinyl compounds such as the methacrylates are susceptible to homopolymerisation reactions which will compete with the grafting reaction to a greater or lesser extent; by contrast with styrene the dominant reaction in the grafting reaction and homopolymers form to only a small extent.

The solvents suitable for use in dissolving the monomer are polar solvents preferably highly polar and of low molecular weight. Particularly suitable solvents are water, the lower alcohols, i.e. methanol and ethanol, dimethyl sulphoxide, dimethyl formamide and dioxane. The solvent in any particular reaction should preferably be chosen so that the monomer, solvent and acid are maintained in a homogenous, single phase solution. If the monomer is itself a liquid and if the acid is misible with, or soluble in, the monomer than it may not be necessary to use a solvent for the monomer.

The acids for use in catalysing the grafting reaction are preferably mineral acids and more preferably the acids are selected from the group consisting of nitric acid, sulphuric acid, hydrochlorine acid and perchloric acid; of these nitric acid is most preferred, particularly at ambient temperatures. Low molecular weight organic acids such as formic acid, acetic acid and trichloro acetic acid can be used when the monomer/wool mixture is irradiated with an activating radiation.

The acid concentration can be varied over a relatively wide range and the best concentration for any given system can be determined by simple experimentation. In monomer solutions the most preferred concentration has been of the order of 0.3N $H^+$; this concentration is not to be considered as necessarily the best concentration for all systems particularly for systems in which the monomer is able to solvate the acid.

Although grafting occurs at all concentrations an increase in the monomer concentration will lead generally to an increase in the rate of grafting of the monomer onto the wool. With a purely acid catalysed reaction the percentage graft initially rises with an increase in monomer concentration, after a certain point further increases in monomer concentration does not lead to an increase in percentage graft until very high monomer concentrations are reached at which time the precentage graft will again rise. In the typical case of styrene in methanol the percentage graft will rise until about 30% styrene is reached, from 30% to 70% styrene the percentage graft will not rise much, if at all. Above 70% styrene in the solution the percentage graft will rise until about 90% styrene at which stage phase separation may take place.

When the grafting takes place under the effect of an ionising radiation a Trommsdorff peak will occur. The monomer concentration corresponding to the peak percentage graft will vary from system to system. Simple testing will determine the peak percentage grafting in any particular system under any particular radiation conditions.

The activating radiation may be in the form of $\beta$-rays, $\gamma$-rays, neutrons, accelerated electrons and particles, X-rays, U.V. radiation or mixtures thereof. The ionising radiation may be furnished by atomic files, particle accelerators, radioisotopes, X-ray generators and other suitable equipment.

The efficiency of the radiation tends to fall off for dose rates of about 100 Kr/hr and it has been found that with $\gamma$ radiation a radiation dose rate of between 25 and 100 Kr/hr is preferred.

As will be observed from the examples described hereinafter the grafting reaction according to this invention proceeds very slowly at 2° C (a typical result would be 25% grafting after 7 months) and that the rate increases sharply with increases in temperatures it is preferred that the reaction be carried out above 10° C.

A further surprising effect found by the present inventors is that if a comonomer solution is used for the grafting which contains a very reactive monomer such as styrene and a very much less reactive monomer such as ethyl acrylate the resulting graft shows a very much higher percentage of the less active monomer than would have been expected. It is thus possible to vary the properties of the resulting wool based copolymer by increasing the quantity of a normally unreactive monomer in the wool copolymer by the use of a comonomer technique.

It is sometimes desirable to carry out the grafting reaction under an inert atmosphere and in the absence of oxygen. It can also be desirable to carry out the grafting in the dark. These procedures may assist in increasing the rate of grafting of the monomer onto the wool and/or the total graft which will occur.

The wool may be brought into contact with the monomer or monomer solution by any suitable means. The wool may be soaked in a bath containing both the monomer and the acid or the monomer may be sprayed onto or otherwise applied to the wool prior to the wool being brought into the presence of the acid, and if desired the radiation.

In a typical procedure used to produce the results set out in the accompanying tables the monomer was first purified by conventional techniques to remove any inhibitors which may have been present. The pure monomer was then diluted with the solvent and a solution of the acid in the solvent then added. The wool sample placed in the reaction mixture in a reaction tube. The reaction tube was then sealed and brought to the desired temperature for the required time.

Upon completion of the reaction period the wool copolymer was removed from the reaction mixture and washed exhaustively with a suitable solvent to remove any homopolymer formed in the reaction. The copolymer was then dried, conditioned, and weighed; the increase in weight of the sample being the weight of monomer grafted onto the wool during the reaction. The weight of monomer grafted relative to the weight of the wool expressed as a percentage is called throughout this specification the "percentage graft" or "% graft".

Referring to the tabulated data:

Table 1 shows the effect of various standing periods compared with blank runs using no acid, Table 2 shows the effectiveness of four different solvents, Table 3 shows the effectiveness of various acids, Table 4 shows the effect of a high ambient temperature on a styrene/methanol system.

Table 5 shows the varying percentage graft obtained with various monomers,

Table 6 6 the grafting of comonomers to wool,

Table 7 shows the effect of time on the grafting of styrene to wool at 43° C,

Table 8 shows the effect of time on the grafting of styrene to wool at 23° C,

Table 9 shows the effect of radiation on the grafting of styrene to wool in the presence of acid, Table 10 shows the effect of low dosage radiation on the grafting of styrene to wool in the presence of acid, Table 11 the effect of various solvents on radiation induced grafting with and without acid, Table 12 shows the effect of various acids on the radiation induced grafting of styrene to wool, and Table 13 shows the effect of varying the acid concentration in the radiation induced grafting of styrene to wool.

In all of the reactions for which results are given in the following tables the ratio of the weight of the reaction mixture to the weight of wool was 50 : 1.

TABLE 1

ACID INDUCED GRAFT OF STYRENE TO WOOL IN METHANOL

ACID: 0.10M. $H_2SO_4$, FIGURES IN COLUMNS 2 to 4 REPRESENT % INCREASE IN WEIGHT.

| SYSTEM | REACTION TIME AT AMBIENT TEMPERATURE IN DARKNESS | | | |
|---|---|---|---|---|
| % STYRENE IN MeOH | 5 days 1st run | 5 days 2nd run | 8 days | 19 days |
| 5 | | | 9.4 | |
| 10 | 11.4 | 11.2 | 18.9 | 12.6 |
| 15 | | | 8.6 | |
| 20 | 13.2 | 15.4 | 11.0 | 12.8 |
| 25 | 14.8 | 15.5 | 19.2 | 16.1 |
| 35 | 20.9 | 25.2 | 40.5 | 23.8 |
| 45 | 38.6 | 30.7 | 22.3 | 80.5 |
| 55 | 21.3 | 43.1 | 33.4 | 984 |
| 65 | 27.2 | 25.0 | 39.2 | 2260 |
| 75 | | | 49.8 | |
| 80 | 29.2 | 22.8 | 55.8 | 2580 |
| 85 | | | 100.2 | |
| 90 | 26.5 | 34.7 | 49.2 | 2810 |

COMPARISON TABLE - BLANK RUNS WITH NO ACID

| % STYRENE IN MeOH | 5 days in light | 19 days in light | 19 days in darkness |
|---|---|---|---|
| 10 | 1.2 | 2.9 | 4.4 |
| 20 | 2.1 | 2.5 | 3.6 |
| 30 | 2.1 | 2.8 | 3.5 |
| 40 | 1.7 | 2.7 | 2.4 |
| 50 | 1.5 | 2.8 | 2.8 |
| 60 | 2.2 | 3.1 | 3.2 |
| 70 | 2.1 | 7.7 | 2.6 |
| 80 | 3.5 | 55.2 | 3.9 |
| 90 | 10.0 | 282 | 2.4 |

NOTE

Although after 19 days in daylight, a peak does occur at 90% concentration and a fairly high yield is obtained, the graft is not uniform but patchy and thus of little commercial value.

TABLE 2

ACID INDUCED GRAFT OF STYRENE TO WOOL IN VARIOUS SOLVENTS.
ACID: 0.10M $H_2SO_4$ REACTION TIME: 9 days at 23° C.

| %STYRENE | METHANOL | | ETHANOL | | DIMETHULSULPHOXIDE | | DIMETHYLFORMAMIDE | |
|---|---|---|---|---|---|---|---|---|
| | %MeOH | %graft | %EtOH | %graft | %DMSO | %graft | %DMF | %graft |
| 10 | 90 | 12 | 90 | 12 | 90 | 13 | 90 | 13 |
| 20 | 80 | 12 | 80 | 13 | 80 | 15 | 80 | 10 |
| 30 | 70 | 10 | 70 | 12 | 70 | 16 | 70 | 12 |
| 40 | 60 | 13 | 60 | 12 | 60 | 22 | 60 | 14 |
| 50 | 50 | 16 | 50 | 13 | 50 | 25 | 50 | 20 |
| 60 | 40 | 19 | 40 | 13 | 40 | 30 | 40 | 25 |
| 70 | 30 | 22 | 30 | 14 | 30 | 34 | 30 | 28 |
| 80 | 20 | 28 | 20 | 17 | 20 | 29* | 20 | 25 |
| 90 | 10 | 28 | 10 | 25 | 10 | 20* | 10 | 10* |

NOTE: In the items marked with an asterisk (*), phase separation occurred.

TABLE 3

ACID INDUCED GRAFT OF STYRENE TO WOOL IN METHANOL

ACIDS: ALL 0.10M REACTION TIME: 10 days at 23° C, except for HCOOH and $CH_3COOH$ which were 4 days at 23° C.

| %STYRENE | %MeOH | %GRAFT | | | | | |
|---|---|---|---|---|---|---|---|
| | | $H_2SO_4$ | HCl | $HNO_3$ | $HClO_4$ | HCOOH | $CH_3COOH$ |
| 10 | 90 | 7 | 6 | 11 | 6 | 1 | 1 |
| 20 | 80 | 7 | 6 | 28 | 7 | 2 | 1 |
| 30 | 70 | 7 | 7 | 45 | 8 | 1 | 1 |
| 40 | 60 | 8 | 6 | 121 | 8 | 1 | 1 |
| 50 | 50 | 12 | 7 | 580 | 10 | 2 | 2 |
| 60 | 40 | 15 | 7 | 1750 | 12 | 0 | 1 |
| 70 | 30 | 15 | 7* | 1660 | 20* | 3 | 4 |
| 80 | 20 | 26 | 7* | 2630 | 20* | 3 | 1 |
| 90 | 10 | 32* | 7* | 3050* | 19* | 44 | 1 |

NOTE: In the items marked with an asterisk (*), phase separation occurred.

TABLE 4

ACID INDUCED GRAFT OF STYRENE TO WOOL IN METHANOL

ACID: 0.10M $H_2SO_4$ REACTION TIME: 45 hours at 50° C.

| %Styrene | %MeOH | %Graft |
|---|---|---|
| 10 | 90 | 15 |
| 20 | 80 | 14 |
| 30 | 70 | 15 |
| 40 | 60 | 57 |
| 50 | 50 | 60 |
| 70 | 30 | 256 |
| 80 | 20 | 898 |
| 90 | 10 | 2210 |

TABLE 5

GRAFTING OF VARIOUS MONOMERS

| | % Graft |
|---|---|
| Acrylamide | 8.4 |
| β-Styrene - $SO_3^-Na^+$ | 14.4 |
| ρ-Styrene - $SO_3^-K^+$ | 21.8 |
| Vinyl $SO_3^-Na^+$ | 14.8 |
| 2, 4 phenyl 1,3 butadiene | 9.4 |
| Isoprene | 16.6 |
| allyl methacrylate | interactable homopolymer |
| αMethyl Styrene | 10.4 |
| Vinyl Acetate | 12.9 |
| iso-Propenyl Acetate | 8.8 |
| Acrylic Acid | 11.4 |
| Allyl Acrylate | 9.1 |
| 4 - tert. Butyl Styrene | 22.9 |
| Divinyl Benzene | 50.2 (may be some white homopolymer attached) |
| Allyl $SO_3^-Na^+$ | 9.4 |
| 2 nitro 2 methyl methacrylate | 17.4 (probably some powdery homopolymer not extracted) |
| Ethylene Dimethacrylate | 25.3 (probably some powdery homopolymer not extracted) |
| N-Lauryl Methacrylate | 9.7 |
| N-Methyl Acrylamide | 8.5 |
| Poly(ethylene glycol dimethacrylate) | interactable homopolymer |
| Vinyl Ethyl Ether | 8.0 |
| Ethyl Acrylate | 7.9 |
| Acrylonitrile | 1000.0 |
| Methyl Methacrylate | interactable homopolymer |
| 4-Vinyl Pyridine | 6.0 |

CONDITIONS: 62 hours at 43° C
50% solution in Methanol 0.2N $HNO_3$

TABLE 6

GRAFT OF COMONOMERS TO WOOL

| MONOMERS | TOTAL GRAFT (%Wt) |
|---|---|
| Styrene, Acrylonitrile | 850 |
| Styrene, Methyl Methacrylate | 1140 |
| Styrene, Ethyl Acrylate | 980 |

Conditions
60% of 1:1 mixture of monomers,
40% of Methanol, 0.2N $HNO_3$
Reacted 48 hours at 43° C

TABLE 7

GRAFT OF STYRENE TO WOOL AT 43° C

| TIME (HOURS) | % GRAFT |
|---|---|
| 1 | 5.7 |
| 2 | 11.8 |
| 3 | 20.0 |
| 4 | 27.0 |
| 5 | 35.0 |
| 6 | 40.0 |
| 7 | 45.0 |
| 8 | 56.0 |
| 9 | 69.0 |
| 14 | 242.0 |
| 32 | 4850.0 |

Conditions 75% Styrene, 25% Methanol 0.2N $HNO_3$

TABLE 8

GRAFT OF STYRENE TO WOOL AT 23° C

| TIME (HOURS) | % GRAFT |
|---|---|
| 6 | 7 |
| 22 | 17 |
| 44 | 57 |
| 68 | 93 |
| 140 | 970 |
| 168 | 1990 |

Conditions 75% Styrene, 25% Methanol 0.2N $HNO_3$

TABLE 9

Effect of Dose in sulphuric acid (0.1M. $H_2SO_4$) on Radiation Grafted Styrene/Wool in Methanol

| Dose* | % GRAFT | | | | | | | | | | | | | |
|---|---|---|---|---|---|---|---|---|---|---|---|---|---|---|
| | 0.2Mr | | 0.25Mr | | 0.30Mr | | 0.35Mr | | 0.40Mr | | 0.45Mr | | 0.50Mr | |
| % Styrene | | $H_2SO_4$ | | $H_2SO_4$ | | $H_2SO_4$ | | $H_2SO_4$ | | $H_2SO_4$ | | $H_2SO_4$ | | $H_2SO_4$ |
| 5 | Nil | 8.4 | Nil | 10.5 | Nil | 8.8 | Nil | 3.5 | Nil | 17 | 0.7 | 21 | 3.0 | |
| 10 | Nil | 21 | 1.2 | 28 | 4 | 35 | 4.3 | 44 | 4.1 | 60 | 10.2 | 83 | 8.5 | "Lost" |
| 15 | 5.7 | 48 | 13 | 75 | 11 | 83 | 25 | 117 | 33 | 166 | 42 | 98 | 54 | "Lost" |
| 20 | 8.6 | 66 | 23 | 92 | 36 | 100 | 29 | 137 | 50 | 325 | 63 | 195 | 76 | 201 |
| 25 | 13 | 83 | 42 | 121 | 51 | 126 | 65 | 225 | 96 | 345 | "lost" | 377 | 116 | 301 |
| 35 | 26 | 114 | 58 | 156 | 88 | 231 | 109 | 435 | 136 | 348 | 142 | 636 | 162 | |
| 45 | 28 | 146 | 67 | 340 | 91 | 375 | 127 | "Lost" | 162 | | 144 | | 188 | |
| 55 | 29 | 187 | 74 | 635 | 100 | | 146 | | 184 | | 188 | | "Lost" | |
| 65 | 27 | 305 | 75 | | 97 | "Lost" | 147 | 692 | 232 | | 215 | | 235 | |
| 75 | 33 | 520 | 76 | | 99 | | 175 | | 400 | | "lost" | | "Lost" | |
| 80 | 33 | 475 | 79 | "lost" | 97 | | 215 | | 328 | "Lost" | 142 | "Lost" | "lost" | "Lost" |
| 85 | 32 | "lost" | 89 | | 104 | 460 | 218 | "lost" | 500 | | "lost" | | 560 | |
| 90 | 38 | 345 | 100 | | 124 | "lost" | 370 | | 570 | | 219 | | "lost" | |
| 95 | 61 | 210 | 124 | | 130 | | 410 | | 560 | | "lost" | | "lost" | |
| 100 | 0.7 | — | 0.8 | | 0.7 | — | nil | — | 1.2 | | 0.7 | | nil | — |

*Dose Rate 25 KR/HR Samples were "Lost" due to very severe polymerization recovery.

This Table shows that (i) at a total dose of 0.2 Mrads, the presence of acid increases the graft.

(ii) at 5 and 10% Styrene concentrations, no graft occurs without acid but significant graft with acid.

(iii) as total dose increases, so does magnitude of acid effect.

(iv) Note that a Trommsdorff peak is induced by acid at 75% styrene/MeOH. The peak is not seen in the higher dose samples because graft was too high and samples could not be recovered.

(v) All data in this Table at constant dose rate of 25,000 rad/hr. (note less than 250,000).

TABLE 10

Effect of Low Total Doses on Radiation Grafting of Styrene in Methanol to Wool at 0.1M $H_2SO_4$ and 25,000 rads/hr.

| %Styrene | Styrene/methanol solutions all 0.1M wr. $H2SO_4$ | | | | | |
|---|---|---|---|---|---|---|
| DOSE | .015MR | .035MR | .07MR | .10MR | .15MR | .20MR |
| 5 | 10.1 | 10.6 | 12.3 | 15.1 | 13.6 | 29.4 |
| 10 | 9.9 | 11.1 | 16.8 | 19.4 | 22.3 | 12.6 |
| 15 | 10.0 | 12.3 | 19.4 | 22.9 | 40.2 | 58.4 |
| 20 | 10.9 | 13.3 | 24.0 | 32.7 | 60.0 | 93.6 |
| 25 | 10.9 | 14.9 | 28.8 | 38.3 | 77.4 | 115 |
| 35 | 13.9 | 20.6 | 42.5 | 45.5 | 110 | 156 |
| 45 | 10.9 | 22.1 | 50.4 | 68.4 | 128 | 1030 |

TABLE 10-continued

Effect of Low Total Doses on Radiation Grafting of Styrene in Methanol to Wool at 0.1M $H_2SO_4$ and 25,000 rads/hr.

| %Styrene | Styrene/methanol solutions all 0.1M wr. $H2SO_4$ | | | | | |
|---|---|---|---|---|---|---|
| DOSE | .015MR | .035MR | .07MR | .10MR | .15MR | .20MR |
| 55 | 17.3 | 26.6 | 57.6 | 65.6 | 153 | |
| 65 | 20.7 | 31.6 | 59.6 | 60.2 | 195 | |
| 75 | 21.6 | 28.2 | 57.0 | 57.8 | 370 | |
| 80 | 22.1 | 32.5 | 59.9 | 13.1 | 675 | "Lost" |
| 85 | 22.6 | 27.1 | 47.6 | 12.3 | 270 | |
| 90 | 19.8 | 23.2 | 36.4 | — | 336 | |
| 95 | 10.1 | 18.9 | 20.6 | 30.6 | 53 | |

(i) At low total doses e.g. 0.015 Mrad, there is no graft without acid (ii) With acid two peaks occur at 0.015, namely at 35% ST/MeOH and 75–85% ST/MeOH (iii) One peak at 0.035, namely 65–80%.

(iv) One peak at 0.07, namely 55–80%

(v) One peak at 0.10, namely 45–65%

(vi) One peak at 0.15, namely 80%

TABLE 11

RADIATION CATALYZED GRAFT OF STYRENE TO WOOL IN VARIOUS SOLVENTS - WITH AND WITHOUT ACID.

| % STYRENE | ETHANOL | | n-PROPANOL | | iso-PROPANOL | | n-BUTANOL | |
|---|---|---|---|---|---|---|---|---|
| | | $0.1MH_2SO_4$ | * | $*0.1MH_2SO_4$ | | $*0.1MH_2SO_4$ | | $0.1MH_2SO_4$ |
| 5 | 4.8 | 10.7 | 3.5 | 4.7 | 2.9 | 2.0 | 3.6 | 0.3 |
| 10 | 3.9 | 10.5 | 3.9 | 5.1 | — | 3.5 | 3.3 | 3.6 |
| 20 | 7.2 | 12.2 | 2.9 | 4.0 | 3.4 | 2.8 | 3.2 | 2.9 |
| 30 | 6.6 | 13.8 | 3.6 | 5.1 | 1.0 | 0.3 | 2.5 | 3.3 |
| 40 | 5.7 | 13.9 | 3.1 | 7.3 | 2.7 | nil | 1.7 | 3.0 |
| 50 | 7.3 | 13.6 | 4.0 | 9.6 | 2.1 | 3.6 | 4.3 | 3.4 |
| 60 | 6.4 | 14.2 | 2.4 | 17.2 | 3.5 | 3.7 | 3.8 | 3.4 |
| 70 | 12.5 | 14.2 | 4.4 | 20.3 | 3.1 | 3.7 | 3.7 | 3.8 |
| 80 | 4.0 | 17.0 | 4.4 | 37.8 | 4.0 | 4.6 | 2.5 | 2.9 |
| 90 | 4.8 | 16.2 | 4.2 | 33.7 | 3.2 | 7.5 | 4.6 | 3.2 |

| % STYRENE | n-OCTANOL | | DIMETHYLFORMAMIDE | | DIMETHYLSULFOXIDE | | DIOXAN | |
|---|---|---|---|---|---|---|---|---|
| | * | $0.1MH_2SO_4$ | | $0.1MH_2SO_4$ | | $0.1MH_2SO_4$ | | $0.1MH_2SO_4$ |
| 5 | 3.2 | 3.9 | 5.5 | 12.1 | 9.0 | 2.5 | 2.5 | 7.1 |
| 10 | 3.1 | 2.3 | 5.6 | 12.7 | 9.8 | 2.9 | 0.2 | 5.2 |
| 20 | 3.2 | 4.2 | 5.6 | 19.5 | 12.4 | 47.3 | 3.0 | 3.9 |
| 30 | 3.2 | 3.3 | 4.8 | 17.1 | 14.1 | 66 | 0.5 | 5.4 |
| 40 | 3.0 | 6.0 | 3.6 | 24.3 | 13.0 | 103 | 3.5 | 4.1 |
| 50 | 1.4 | 4.2 | 4.3 | 17.7 | 13.2 | 163 | 1.6 | 5.9 |
| 60 | 3.0 | 4.8 | 2.3 | 12.1 | 8.3 | 176 | 1.2 | 7.3 |
| 70 | 3.0 | 5.3 | 2.8 | 7.4 | 7.6 | 306 | 3.0 | 8.1 |
| 80 | 4.2 | 7.2 | 2.0 | 7.2 | 5.4 | 352 | 3.8 | 9.3 |
| 90 | 3.4 | 13.3 | 3.6 | 4.4 | 6.6 | 65 | 1.9 | 12.1 |

*Total DOSE 1.2MRAD

NOTES ON TABLE 11

(i) Compare data with Table 10 for methanol figures; these show that after methanol there is a sharp drop in the effect of the other alcohols. This contrasts with the cellulose results where cut-off in alcohol efficiency occurs after n-propanol.

(ii) Propanol is better than the isomer isopropanol.

(iii) In the other alcohols where significant graft is achieved, the peak occurs at ~80% ST/MeOH.

(iv) Of the other solvents DMSO is almost as good as MeOH with the acid effect and also without acid.

(v) DMSO gives a mild Trommsdorff at 30% ST/DMSO without acid and a strong one at 80% DMSO with acid (0.1).

(vi) DMF is next best solvent to DMSO and methanol with the acid. With acid, Trommsdorff occurs at 40% ST/DMF.

(vii) Dioxane also gives an acid effect.

TABLE 12

EFFECT OF VARIOUS ACIDS ON THE RADIATION CATALYSED GRAFT OF STYRENE TO WOOL IN METHANOL SOLUTIONS.

| ACID | % STYRENE | % GRAFT | DOSE |
|---|---|---|---|
| 0.1 NHCl | 30 | 6.1 | 0.10 MRAD at 25KR/HR |
| | 45 | 5.7 | |
| | 60 | 7.5 | |
| | 75 | 5.6 | |
| $0.1\ NHNO_3$ | 30 | 18.0 | " |
| | 45 | 33.2 | |
| | 60 | 50.8 | |
| | 75 | 54.0 | |
| $0.1\ NHClO_4$ | 30 | 49.2 | " |
| | 45 | 52.8 | |
| | 60 | 79.2 | |
| | 75 | 71.4 | |
| $0.1N\ H_2SO_4$ | 30 | 39.5 | " |
| | 45 | 56.6 | |
| | 60 | 76.4 | |
| | 75 | 68.9 | |
| NO ACID | 30 | 10.3 | " |
| | 45 | 10.0 | |
| | 60 | 9.1 | |
| | 75 | 15.6 | |
| 0.1N H.COOH | 10 | 12.8 | |
| | 20 | 53.5 | 0.20 MRAD at 25 KR/HR |
| | 30 | 87.8 | |
| | 40 | 113 | |
| | 50 | 124 | |
| | 60 | 133 | |
| | 70 | 127 | |
| | 80 | 153 | |
| | 90 | 191 | |
| $0.1N\ CH_3COOH$ | 10 | 9.2 | |
| | 20 | 33.7 | 0.20 MRAD at 25 KR/HR |
| | 30 | 53.8 | |
| | 40 | 71.0 | |
| | 50 | 89.6 | |
| | 60 | 96.8 | |
| | 70 | 102 | |
| | 80 | 108 | |

TABLE 12-continued

EFFECT OF VARIOUS ACIDS ON THE RADIATION CATALYSED GRAFT OF STYRENE TO WOOL IN METHANOL SOLUTIONS.

| ACID | % STYRENE | % GRAFT | DOSE |
|---|---|---|---|
| | 90 | 134 | |

NOTES ON TABLE 12

(i) All acids used accelerated grafting.

(ii) Order for inorganic acids was $HClO_4 > H_2SO_4 > HNO_3 > HCl$.

(iii) Order for organic acids was $HCOOH > CH_3COOH$.

(iv) Higher dose was used with the organic acids which appear to be not quite as good as $HNO_3$ but better than HCl. However, for HCl see Table 13 at 0.05M HCl.

(v) With all inorganic acids except $HNO_3$. Trommasdorff observed, e.g. all at 60% ST/solvent.

(vi) Of the organic acids, only HCOOH shows slight Trommsdorff at 60%.

TABLE 13

EFFECT OF ACID CONCENTRATION ON RADIATION CATLYSED GRAFT OF STYRENE TO WOOL IN METHANOL SOLUTION.

| ACID | CON (N.) | % STYRENE | % GRAFT | DOSE |
|---|---|---|---|---|
| HCl | .01 | 60 | 11.9 | 0.10 MRAD at 25 KR/HR |
| | .05 | " | 50.2 | |
| | .10 | " | 7.5 | |
| | .24 | " | 7.3 | |
| | .38 | " | 7.2 | |
| $HNO_3$ | .01 | 60 | 31.5 | |
| | .05 | " | 43.8 | |
| | .10 | " | 50.8 | |
| | .33 | " | 77.0 | |
| | .50 | " | 85.6 | |
| $H_2SO_4$ | .01 | 60 | 24.5 | |
| | .05 | " | 67.6 | |
| | .10 | " | 76.4 | |
| | .29 | " | 99.2 | |
| | .50 | " | 91.0 | |
| $HClO_4$ | .01 | 60 | 43.8 | |
| | .05 | " | 82.0 | |

TABLE 13-continued

EFFECT OF ACID CONCENTRATION ON RADIATION CATLYSED GRAFT OF STYRENE TO WOOL IN METHANOL SOLUTION.

| ACID | CON (N.) | % STYRENE | % GRAFT | DOSE |
|---|---|---|---|---|
| | .10 | " | 79.2 | |

NOTES ON TABLE 13

(i) HCl and $HClO_4$ peak at 0.05N (ii) $H_2SO_4$ peaks at 0.3N (iii) $HNO_3$ peaks at 0.5N but with higher acidities phase separation of monomer is observed above 30% ST/solvent.

(iv) At peak concentrations, efficiency of acids is $H_2SO_4 > HClO_4 > HNO_3 > HCL$

We claim:

1. A method of grafting a (monomeric substance) vinyl monomer containing sterically available vinyl group onto wool (comprising) consisting of contacting the wool with (the monomer or) a solution (of the monomer) containing at least 30% by weight monomer based on the total weight of the solution in a polar solvent in the presence of a single chemical catalyst, said chemical catalyst being (a mineral acid or an organic acid containing up to 3 carbon atoms) nitric acid, the acid being present in an amount such that the reaction mixture is not more than 0.5N relative to said acid.

2. A method as claimed in claim 1, in which the vinyl group is in a terminal position in the monomeric substance.

3. A method as claimed in claim 1, in which the wool is simultaneously brought into contact with two or more monomers or a solution thereof in a polar solvent.

4. A method as claimed in claim 1, in which the solvent is selected from the group comprising water, methanol, ethanol, dimethyl sulfoxide, dimethyl formamide and dioxane.

5. A method as claimed in claim 1, in which the wool and the monomer, or monomer solution, in contact therewith, are reacted at a temperature of more than 10° C.

6. A method as claimed in claim 1, in which the wool, and the monomer, or monomer solution, in contact therewith, are reacted in an atmosphere devoid of oxygen.

7. A method as claimed in claim 1 in which the monomer is selected from the group comprising styrene and acrylonitrile.

8. A method as claimed in claim 1 in which the monomer is selected from the group comprising styrene and methyl methacrylate.

9. A copolymer of wool and a monomeric substance containing a vinyl group produced according to claim 1.

* * * * *